US006321736B1

(12) United States Patent
McPherson

(10) Patent No.: US 6,321,736 B1
(45) Date of Patent: Nov. 27, 2001

(54) ROUND WHEEL CAM

(76) Inventor: Mathew A. McPherson, 19055 Incline Rd., Norwalk, WI (US) 54648

( * ) Notice: Subject to any disclaimer, the term of this patent is extended or adjusted under 35 U.S.C. 154(b) by 0 days.

(21) Appl. No.: 09/502,354

(22) Filed: Feb. 11, 2000

(51) Int. Cl.[7] ..... F41B 5/10
(52) U.S. Cl. ..... 124/25.6; 124/25; 124/900
(58) Field of Search ..... 124/25, 25.6, 900

(56) References Cited

U.S. PATENT DOCUMENTS

| | | | | |
|---|---|---|---|---|
| D. 331,614 | | 12/1992 | Martin et al. | D22/107 |
| 3,841,295 | | 10/1974 | Hunter . | |
| 3,854,467 | | 12/1974 | Hofmeister . | |
| 3,958,551 | | 5/1976 | Ketchum . | |
| 3,993,039 | | 11/1976 | Groves et al. . | |
| 4,023,551 | | 5/1977 | Huddleston | 124/92 |
| 4,324,222 | | 4/1982 | Gasser | 124/89 |
| 4,365,611 | * | 12/1982 | Nishioka | 124/25.6 |
| 4,372,285 | | 2/1983 | Simonds et al. | 124/90 |
| 4,401,097 | | 8/1983 | Simonds et al. . | |
| 4,438,753 | | 3/1984 | Simonds . | |
| 4,440,142 | | 4/1984 | Simonds . | |
| 4,458,657 | | 7/1984 | Stockmar | 124/17 |
| 4,461,267 | | 7/1984 | Simonds et al. . | |
| 4,478,203 | | 10/1984 | Hayes . | |
| 4,512,326 | | 4/1985 | Jarrett . | |
| 4,628,892 | | 12/1986 | Windedahl et al. . | |
| 4,649,891 | | 3/1987 | Bozek | 124/25 |
| 4,660,536 | | 4/1987 | McPherson . | |
| 4,693,228 | | 9/1987 | Simonds et al. | 124/25 |
| 4,827,894 | | 5/1989 | Schallberger | 124/25 |
| 4,838,236 | | 6/1989 | Kudlacek . | |
| 4,909,231 | | 3/1990 | Larson . | |
| 4,979,488 | | 12/1990 | Fenton et al. | 124/25.6 |
| 4,993,399 | | 2/1991 | Chattin | 124/25.6 |
| 5,005,554 | | 4/1991 | Shepley et al. | 124/24.1 |
| 5,016,604 | | 5/1991 | Tilby | 124/92 |
| 5,025,771 | | 6/1991 | Hanson | 124/25 |
| 5,040,520 | | 8/1991 | Nurney | 124/25.6 |
| 5,174,268 | | 12/1992 | Martin et al. | 124/25.6 |
| 5,307,787 | | 5/1994 | LaBorde et al. | 124/25.6 |
| 5,368,006 | | 11/1994 | McPherson | 124/25.6 |
| 5,411,009 | | 5/1995 | Thompson et al. | 124/89 |
| 5,495,843 | | 3/1996 | Larson | 124/25.6 |
| 5,505,185 | | 4/1996 | Miller | 124/25.6 |
| 5,515,836 | | 5/1996 | Martin et al. | 124/23.1 |
| 5,638,804 | | 6/1997 | Remick et al. | 124/25.6 |
| 5,649,520 | | 7/1997 | Bednar | 124/25 |
| 5,678,529 | | 10/1997 | Larson | 124/25.6 |
| 5,782,229 | | 7/1998 | Evans et al. | 124/25.6 |
| 5,809,982 | | 9/1998 | McPherson | 124/25.6 |
| 5,884,614 | | 3/1999 | Darlington et al. | 124/25 |
| 5,934,265 | | 8/1999 | Darlington | 124/25.6 |
| 6,098,607 | * | 8/2000 | Strother | 124/25.6 |

OTHER PUBLICATIONS

Bow & Arrow publication of Apr. 1980.
Bow & Arrow publication Dec. 1975.
Advertising from Allen, The Original Compound Bow, Dec. 1975.
DYNABO ( Models M–10 Cheetah & Jim Cox Magnum) Instruction Manual Excerpt, mid–1970's.
KAM–ACT "MK–2" Instruction Manual Excerpt, early–1970's.
KAM–ACT Instruction Manual Excerpt for Martin Archery, Inc., "New for '74'", mid–1971's.
Ben Pearson Archery advertisement.
Hoyt Archery advertisement.
Browning advertisement.

* cited by examiner

*Primary Examiner*—John A. Ricci

(57) ABSTRACT

An archery bow includes a handle portion, an upper limb supported by the handle portion and a lower limb supported by the handle portion. A top pulley is rotatably mounted upon the upper limb for rotation about a first axle. The top pulley includes a pulley track. A bottom cam assembly is rotatably mounted upon the lower limb for rotation about a second axle. The bottom cam assembly has a primary string payout track and a secondary string payout track. The primary string payout track is characterized by a constant radius of curvature.

25 Claims, 8 Drawing Sheets

ROUND WHEEL CAM

BACKGROUND OF THE INVENTION

Animals are known for their heightened senses and quick reflexes. It is axiomatic to the experienced hunter that animals can hear and quickly respond to even the slightest of sounds. The noise associated with the release of a bow and the shooting of an arrow toward an animal may be sufficient to alert the animal to move out of the way of the oncoming arrow.

One approach to quieting a bow is to provide a stabilizer to damp out vibrations in the bow. An example of a stabilizer is disclosed in U.S. Pat. No. 4,324,222 to Gasser. Another approach is to provide elastic members each having one end attached to a specific region of the bow string and the other end secured to a respective adjacent limb at a point intermediate the ends of the limb as disclosed in U.S. Pat No. 4,628,892 to Windedahl et al. The use of bow string silencers is also disclosed in U.S. Pat. No. 4,023,551 to Huddleston and U.S. Pat. No. 5,016,604 Tilby. Another approach for eliminating noise and vibration from compound bows involves the use of a fluid filled tube mounted horizontally to the bow body to absorb vibrations as disclosed in U.S. Pat. No. 5,411,009 to Thompson et al. Yet another approach involves the use of a cam shield as disclosed in U.S. Pat. No. 4,979,488 to Fenton et al.

In spite of the various approaches available for silencing bows, there is a need for additional innovations in bow design, in particular in the area of compound bows given the complexity of their construction, to provide a quiet design.

The compound bow is generally characterized by the presence of one or more leveraging devices, typically on the distal ends of the bows limbs. The leveraging devices are used to generate a mechanical advantage favoring the archer. As a compound bow is drawn, the force required to displace the bowstring increases rapidly to a maximum value, typically prior to reaching the mid-point of the draw cycle. At some point beyond mid-draw, the force required to displace the bow string an additional amount decreases with each additional increment of displacement. As a result, at full draw the archer is only required to exert a fraction of the maximum force that was required to initially draw the bow.

One of the earliest compound bows is described in U.S. Pat. No. 3,486,495 to Allen. Although Allen discloses the use of programmed cams, such cams did not actually appear in the marketplace until the advent of computer numerically controlled (CNC) machinery made them economically feasible to produce and sell.

With the advent of CNC machinery, the state of the art has progressed from circular cam profiles to programmed non-circular profiles that result in the ability to store more energy in the bow and therefore provide more energy to accelerate an arrow to a higher launch velocity.

Improvements in cam design have been accompanied by advances in the design of the cable rigging. Some of the early compound bows had auxiliary intermediate idler pulleys with their anchor cables adjustably fastened to the handle sections of the bows. Typically, such bows had two cam elements each mounted independently and requiring very meticulous adjustments to each to synchronize the action of the two cam elements to achieve optimum performance.

More recent dual cam bows have been rigged such that the anchor cables of one cam were secured to the axle which mounts the opposite cam. This tied the system together and provided a degree of corrective feedback that made it difficult to detect discrepancies in eccentric wheel synchronization.

Unfortunately, however, with the advent of programmed cams that were capable of storing even more energy, the cam synchronization problem reappeared and the problem increased with increases in energy storage capability combined with progressively lower holding weights.

The innovation of the dual feed-out single take-up single cam compound bow, disclosed inter alia, in U.S. Pat. No. 5,368,006 provided a major step forward in the simplification of the compound bow.

The background of compound bow development is well documented in the patents that have been granted in this area and for a deeper understanding of the state of the art one can find additional information in the following patents and the patents which they reference:

| U.S Pat. No. | Issued To |
|---|---|
| 3,841,295 | Hunter |
| 3,854,467 | Hofmeister |
| 3,958,551 | Ketchum |
| 4,440,142 | Simonds |
| 4,838,236 | Kudlacek |
| 5,040,520 | Nurney |
| 5,307,787 | LaBorde et al. |
| 5,368,006 | McPherson |
| 5,505,185 | Miller |
| 5,678,529 | Larson |

For the purpose of this disclosure, all U.S. patents and patent applications and all other publications referenced herein are incorporated herein by reference in their entirety.

BRIEF SUMMARY OF THE INVENTION

The present invention is directed in one embodiment to an archery bow comprising a handle portion, an upper limb supported by the handle portion and a lower limb supported by the handle portion. A top pulley is rotatably mounted upon the upper limb for rotation about a first axle. The top pulley includes a pulley track. A bottom cam assembly is rotatably mounted upon the lower limb for rotation about a second axle. The bottom cam assembly has a primary string payout track and a secondary string payout track. The primary string payout track is at least semicircular.

The archery bow may further comprise a first cable having a first end portion terminating in a first end anchored to the bottom cam assembly and a second end portion terminating in a second end anchored to the bottom cam assembly. The first end portion is received in the primary string payout track, the second end portion is received in the secondary string payout track. A portion of the first cable is trained about the top pulley and received in the pulley track to form a bow-string section and a return section.

Where the bottom cam assembly further comprises a takeup track, the archery bow may further comprise an anchor cable extending between the upper limb and the bottom cam assembly and received in the take-up track.

The instant invention is also directed to an archery bow having a rotatably mounted pulley with a track and a dual feed-out cam with a larger track and smaller track, wherein the improvement comprises a larger track which is substantially similar in shape to the pulley track.

BRIEF DESCRIPTION OF THE SEVERAL VIEWS OF THE DRAWING(S)

Figure 4A:
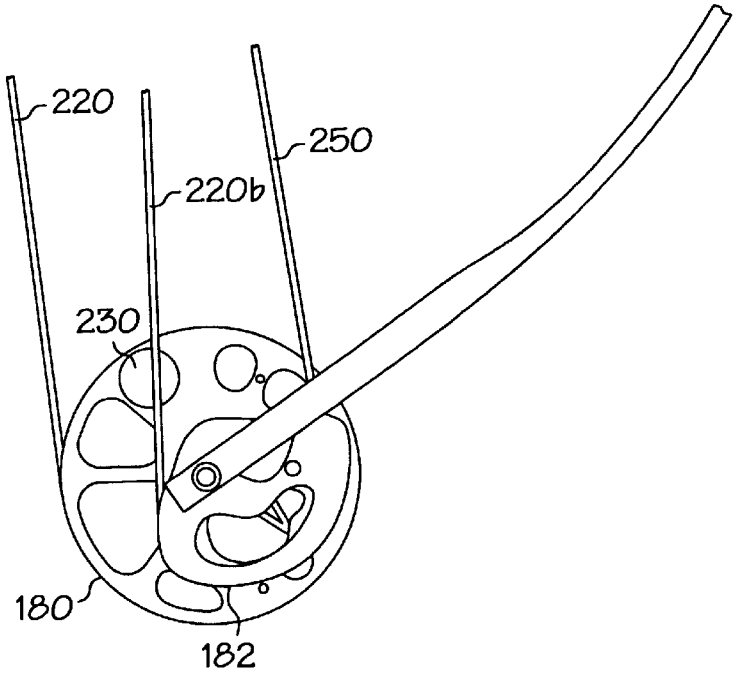
Figure 4B:
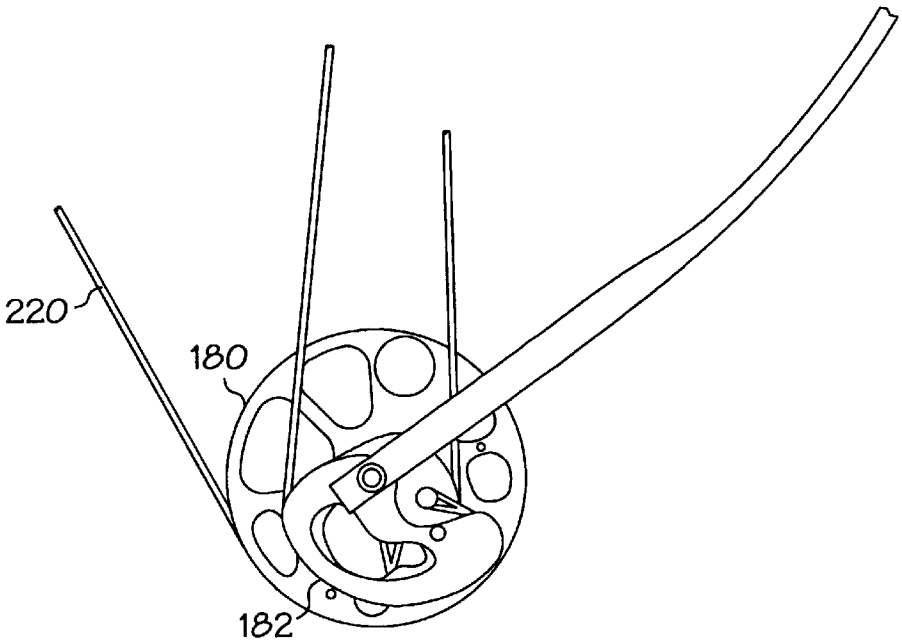
Figure 4C:
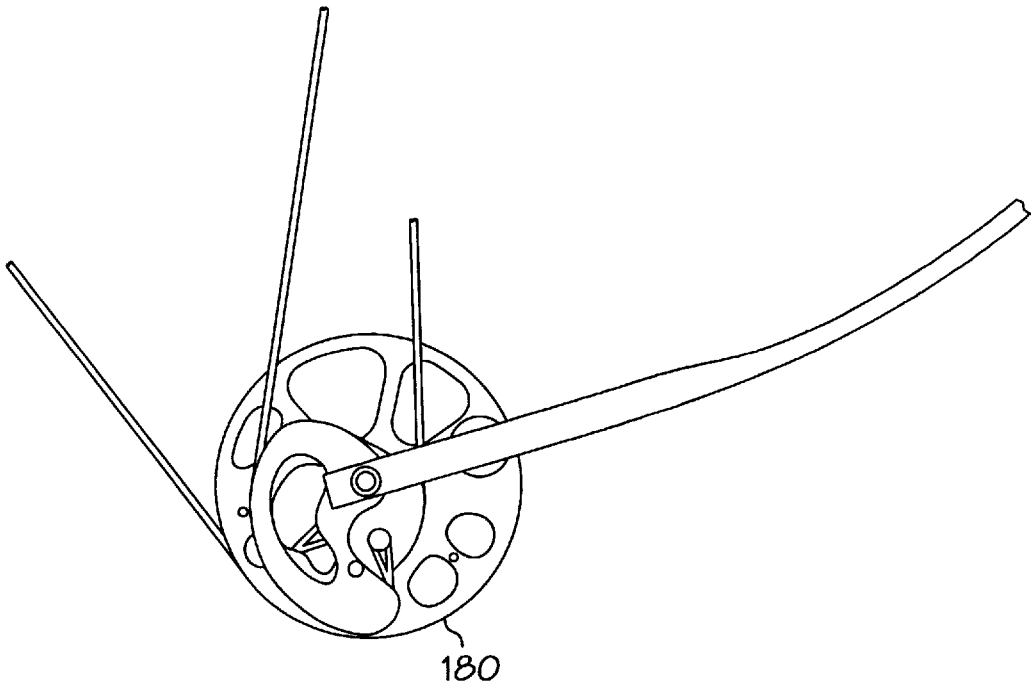
Figure 4D:
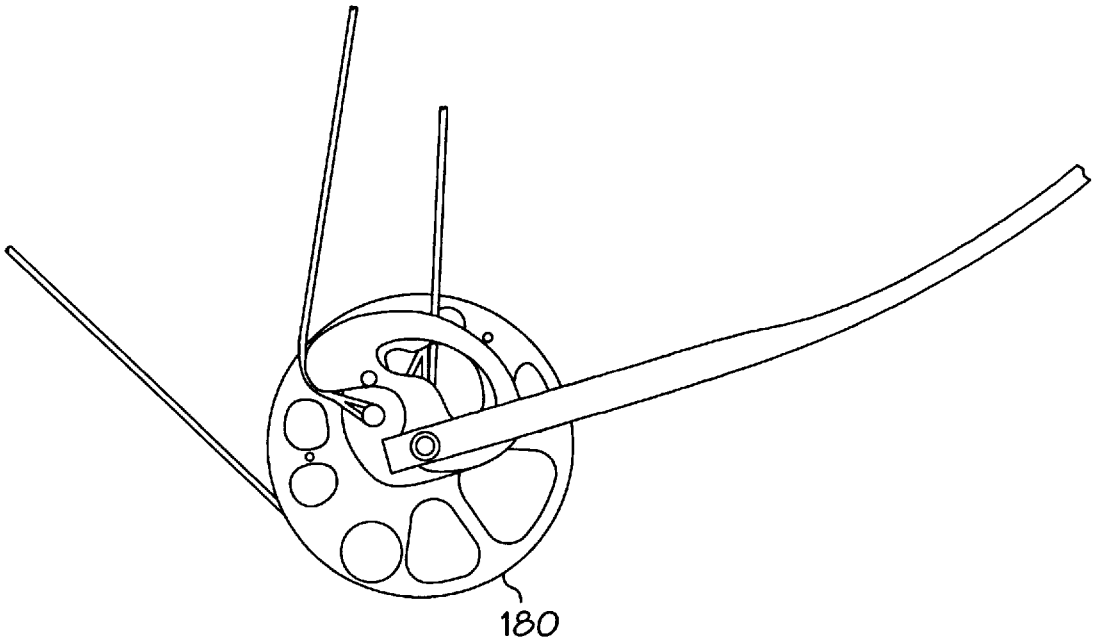
Figure 4E:
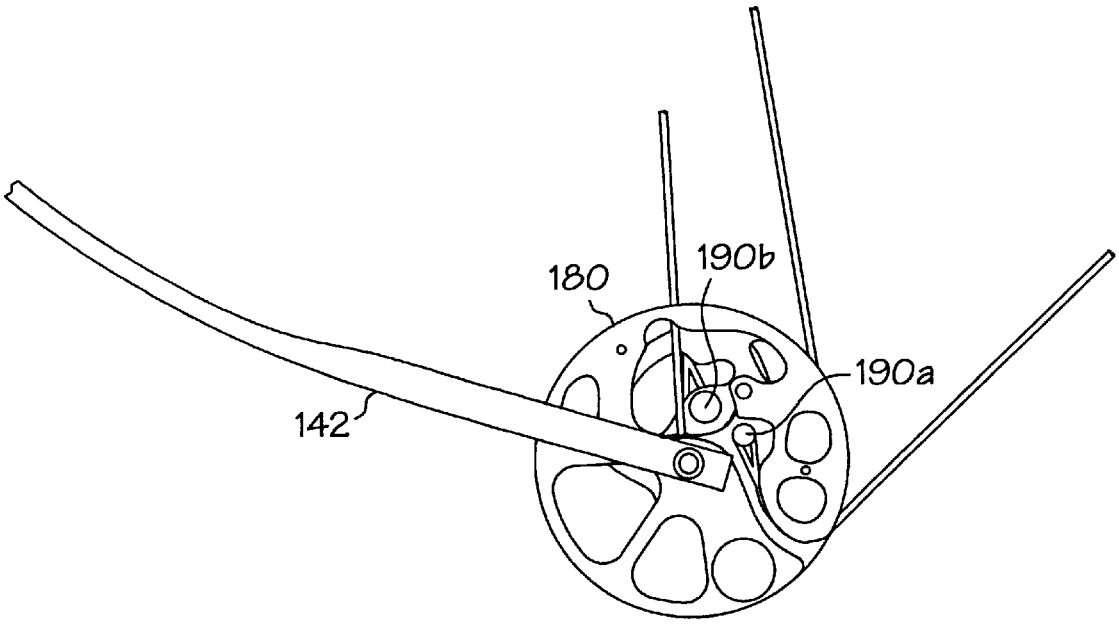

FIGS. 4*a*–4*e* show the cam assembly in various states ranging from undrawn (a) to fully drawn (d);

FIG. 4*e* shows the reverse side of the cam shown in FIG. 4*d*.

Figure 4F:
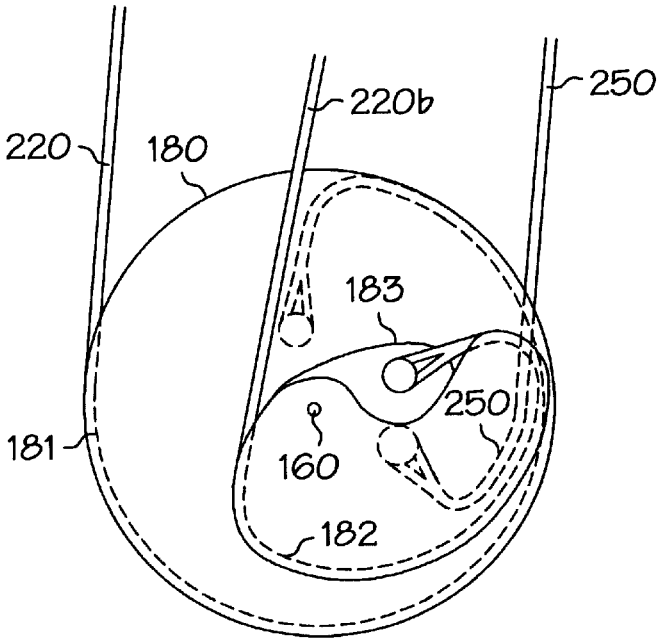

FIG. 4*f* shows a fragmentary elevational of the cam assembly.

Figure 5A:
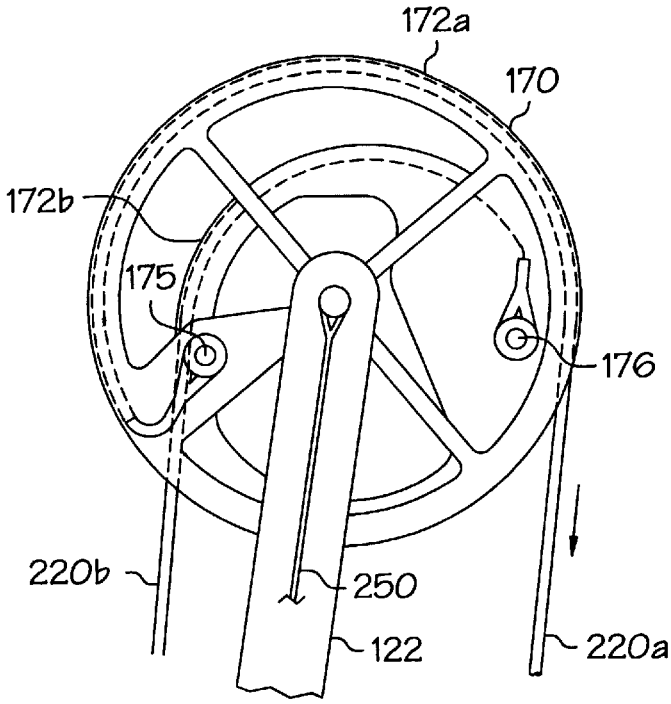
Figure 5B:
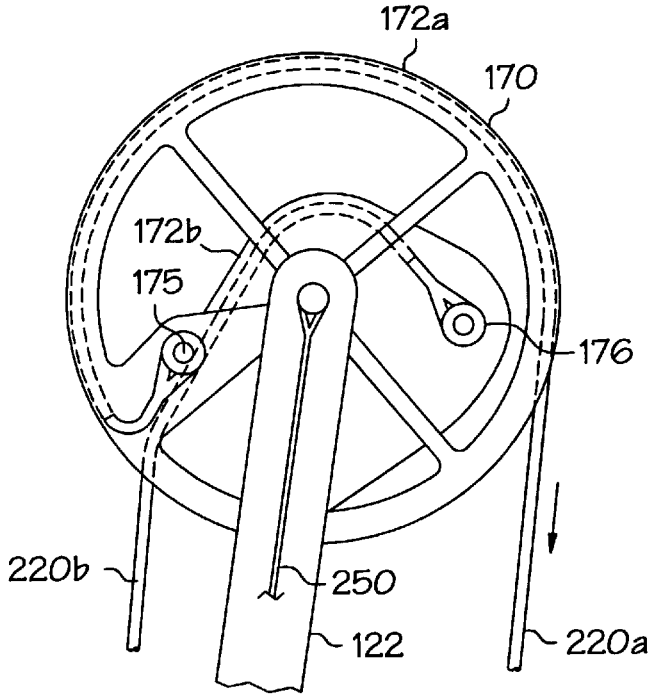
Figure 6:
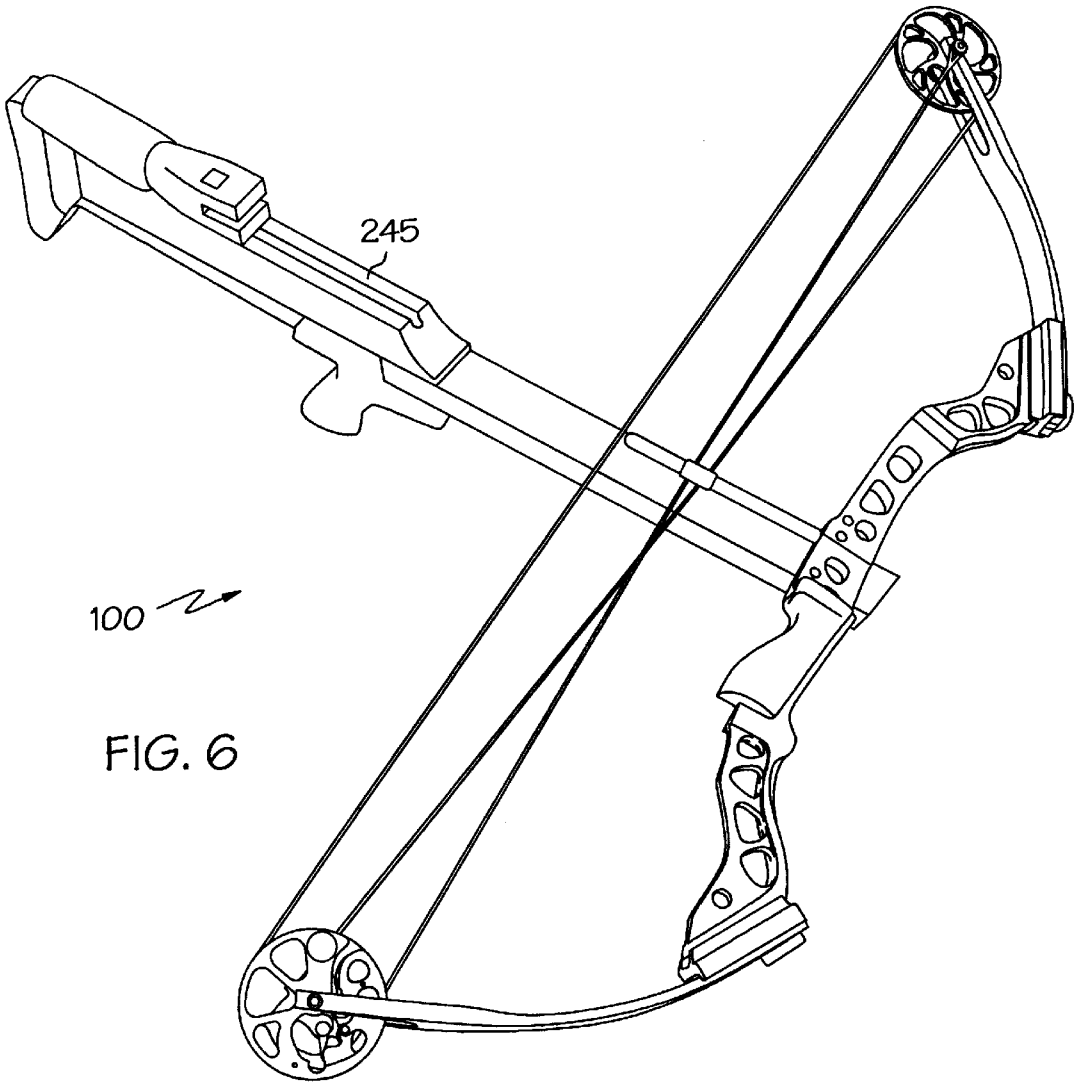

FIGS. 5*a* and 5*b* show pulleys that may be used in conjunction with the inventive bows;

FIG. 6 shows an inventive crossbow.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
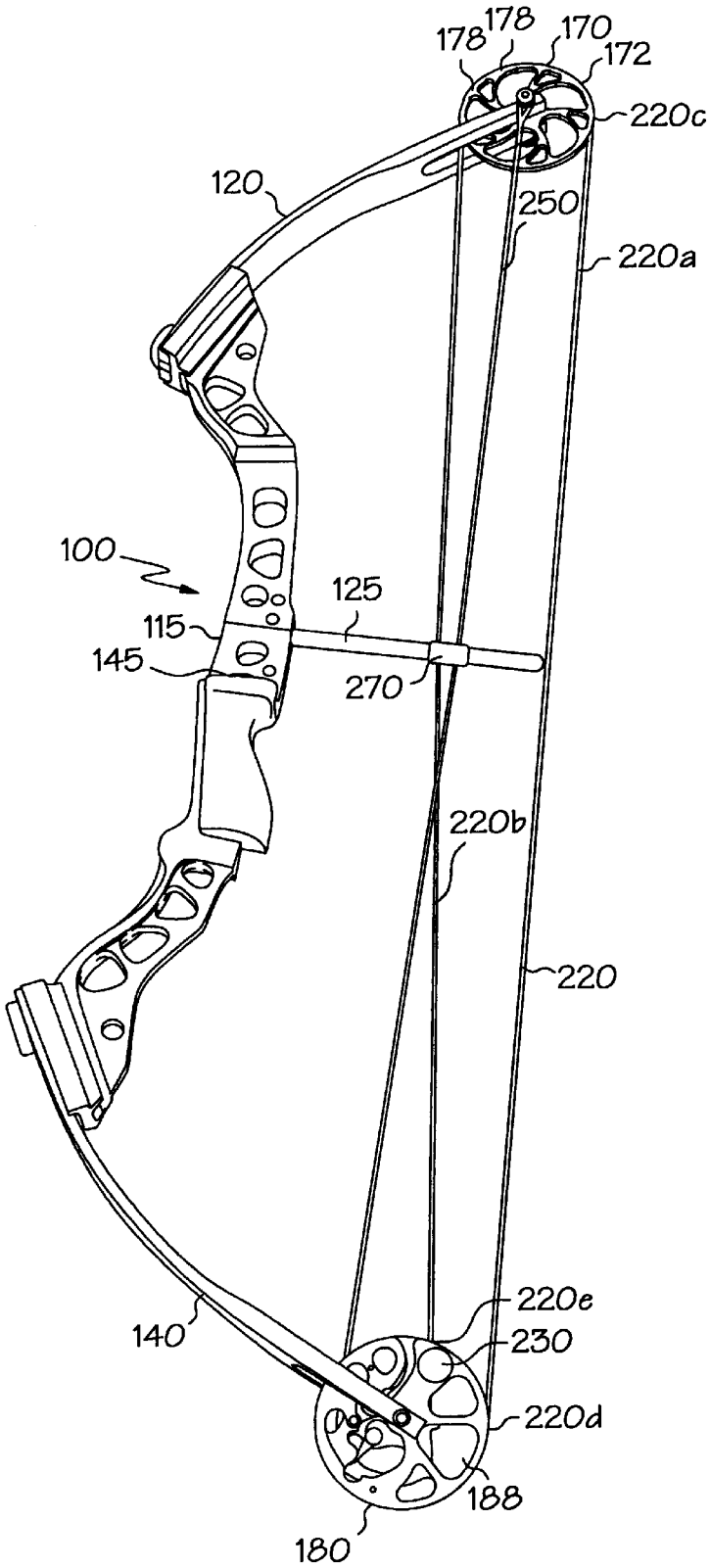
FIG. 1 is a side elevational view of one embodiment of the archery bow structured in accordance with the present invention.

The inventive bow, shown generally at 100 in FIG. 1, in the undrawn state includes a handle portion 115 with an upper flexible limb 120 and a lower flexible limb 140 supported thereon. Handle portion 115 includes an arrow rest 145 thereon. Upper and lower limbs 120 and 140 provide the desired resistance to bending which determines the draw weight of the bow and the force with which the arrow (not shown) is discharged.

Figure 2:
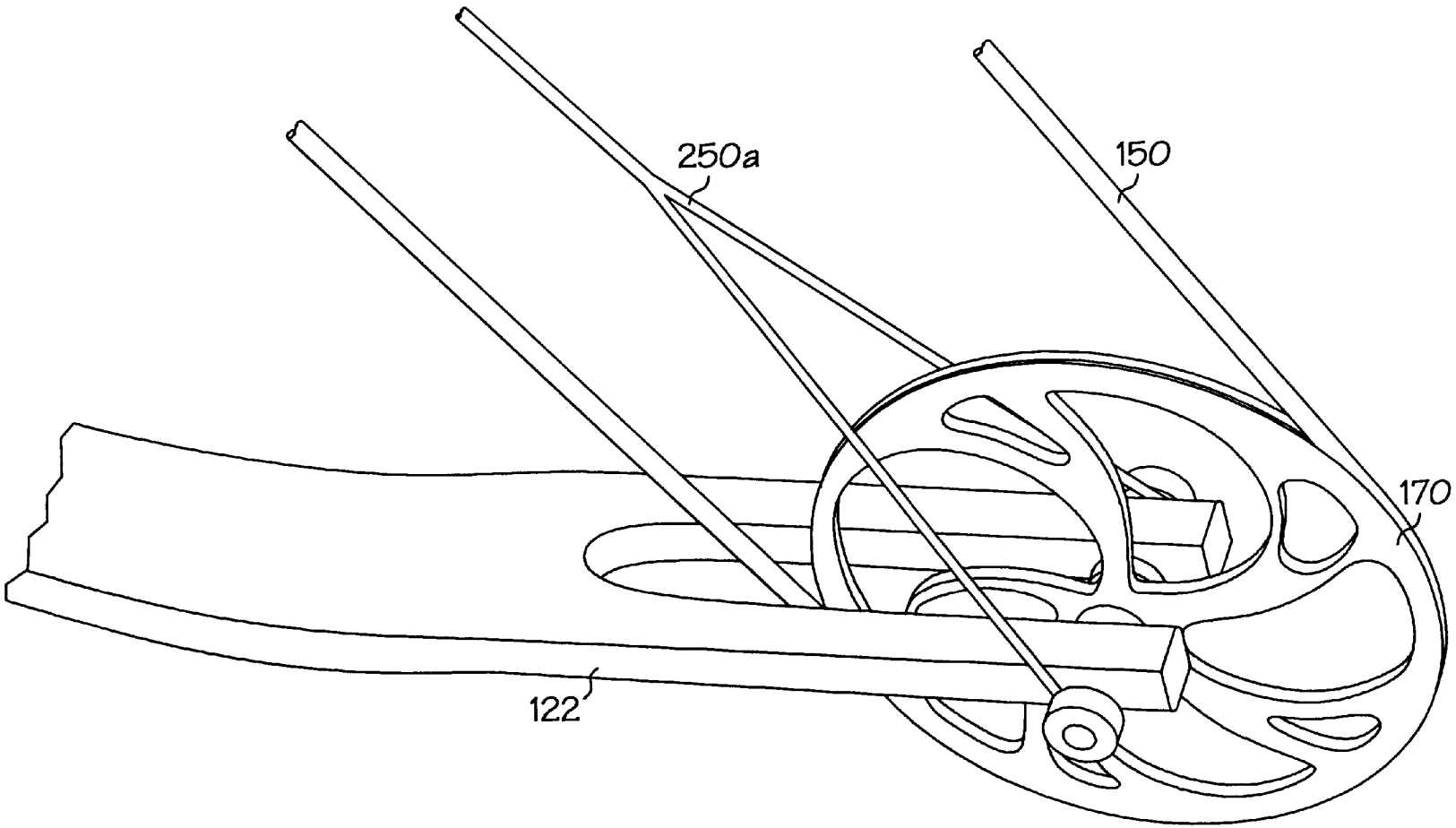
FIG. 2 is a perspective view of the outer end of the upper limb and pulley.
Figure 3:
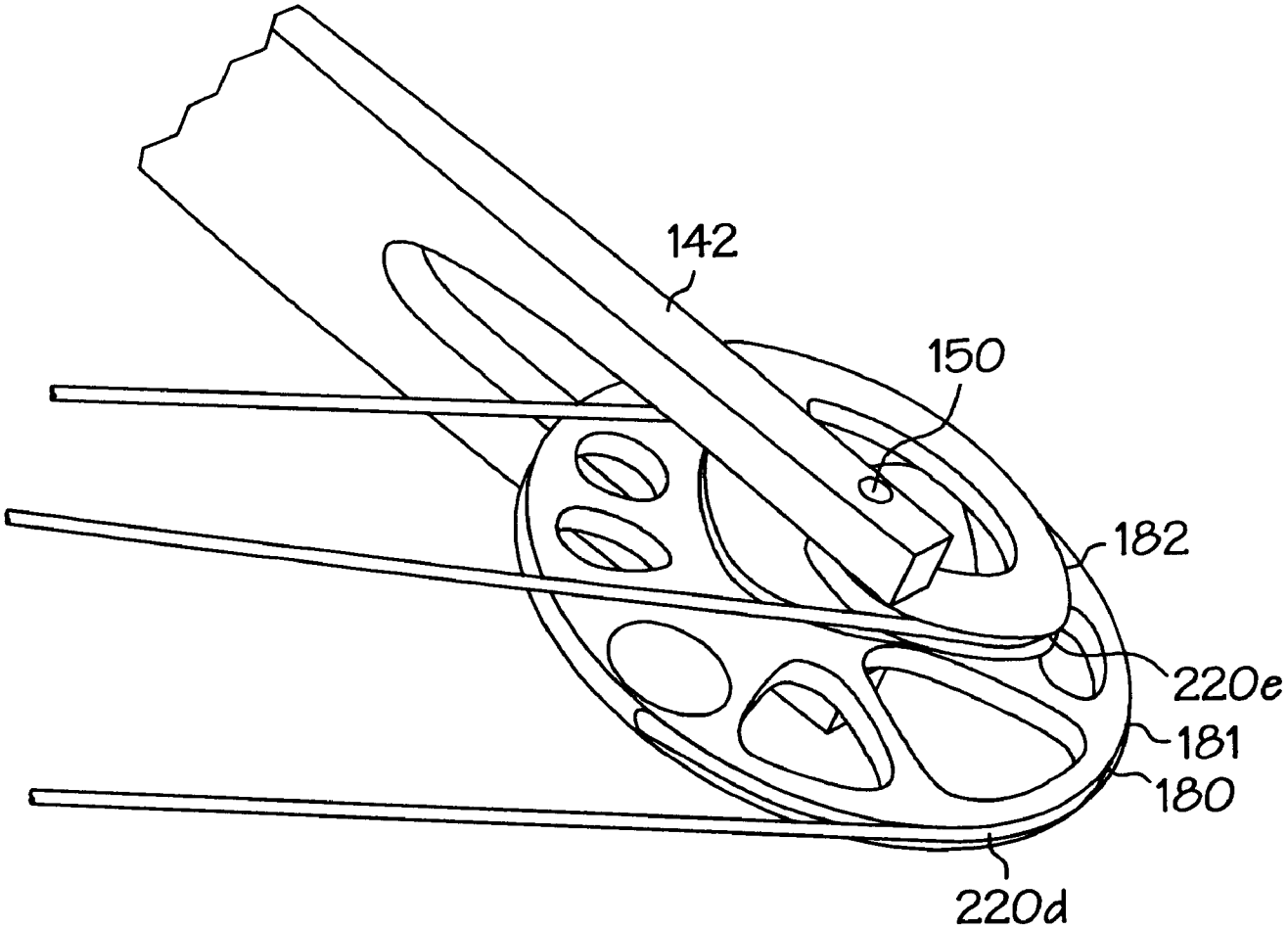
FIG. 3 is a perspective view of the outer end of the lower limb and cam assembly.

As shown in FIGS. 2 and 3, the outer ends of the upper and lower bow limbs provide wheel receiving slots which define wheel mounting forks, respectively designated by the numbers 122 and 142, for mounting axle pins 150 and 160. On the outer end of the upper bow limb, an idler or pulley 170 is concentrically mounted on axle pin 150 for rotation about axle pin 150. Pulley 170 is provided with a single track 172.

On the outer end of the lower bow limb, circular cam 180 is mounted on an axle pin 160 for rotation about axle pin 160. As shown in FIGS. 3 and 4*a*–4*f*, cam 180 has a substantially circular track 181 and two eccentrically oriented tracks, 182 and 183 formed in the outer periphery thereof to provide three separate cable tracks.

Bow 100 further includes a first cable 220 which is trained around top pulley 170 to form bow-string 220*a* and return section 220*b*. Upper section 220*c* of first cable 220 is received in track 172. The end portions 220*d* and 220*e* of first cable 220 are received in tracks 181 and 182, respectively on bottom cam assembly 180, as shown in FIGS. 3*a* and 4*e*.

Pay-out track 181 allows for pay-out of additional cable to section 220*a* as section 220*a* of cable 220 is drawn out. Secondary string pay-out track 182 allows for pay-out of additional cable to section 220*b* as section 220*a* of cable 220 is drawn out. The ends of the section 220*d* and 220*e* of section 220*a* and 220*b* are anchored to bottom cam assembly 180 by cable anchor pins 190*a* and 190*b* fixed to cam 180.

First cable 220 functions as a bow string.

As best shown in FIG. 2, an anchor cable 250 is anchored at one forked end 250*a* to axle pin 150 and at the other end passes around cam track 183 on the take-up side of cam 180 and is anchored to cam 180. Cam track 183 takes up anchor cable 250 as the bow is drawn and the upper and lower limbs 120 and 140 draw nearer to one another and positively ties the two bow limbs 120 and 140 together to form a direct connection between the limbs 120 and 140.

Bow 100 further includes guide 125 extending from handle portion 115. Return section 220*b* and anchor cable 250 are slidably coupled to guide via coupler 270.

As shown in FIGS. 4*a*–4*e*, as bow-string 220*a* is drawn, a length of first cable 220 is unwound from track 172 about pulley 170 and pulley 170 rotates about its axis. Moreover, cam 180 rotates about its axis and additional bow-string 220*a* is unwound from track 181. As bow-string 220*a* is unwound, additional length of return section 220*b* is unwound from track 182. Simultaneously, bow limbs 120 and 140 are drawn toward one another and a portion of anchor cable 250 is wound around cam track 183 storing energy in limbs 120 and 140 respectively.

Top pulley 170 is shown in the figures as having a plurality of openings 178 therethrough which reduce the weight of the pulley assembly. The openings may be differently shaped and/or arranged. The pulley may optionally have additional or fewer openings therethrough or may be of solid construction. A reduced weight pulley having recessed portions rather than openings extending therethrough may also be used.

Similarly, bottom cam assembly 180 is shown in the figures as having a plurality of openings 188 therethrough which reduce the weight of the bottom cam assembly. The openings may be differently shaped and/or arranged. The bottom cam may optionally have additional or fewer openings therethrough or may be of solid construction. A reduced weight bottom cam having recessed portions rather than openings extending therethrough may also be used. Bottom cam assembly 180, as further seen in the figures, may also have an optional weighted disk 230. Details of the weighted disk may be found in U.S. Pat. No. 5,809,982 and U.S. patent application Ser. No. 09/082,099.

The invention further contemplates the use of idler wheels or pulleys having more than one track in place of pulley 170 shown in FIGS. 1–2. Where a two track idler is used, the bow string which comes from the main string pay-out track of the bottom cam wraps partially around one track of the idler and is then affixed to the idler. The bowstring which is paid out from the secondary string payout track is wrapped around the opposite side and track of the two track idler and is then affixed to the idler.

An example of a two track idler or pulley is shown at 170 in FIG. 5*a*. Pulley 170 includes first pulley track 172*a* and second pulley track 172*b*. An end portion of first cable 220*a* is trained about semi-circular first track 172*a* of pulley 170 to form a bow-string section. First cable 220*a* is anchored to pulley 170 with cable anchor pin 175. Optionally, first cable 220*a* may be anchored in the first pulley track. The other end of first cable 220*a* is received in the primary string payout track of the bottom cam assembly of the bow. An end portion of second cable 220*b* is trained about semi-circular second pulley track 172*b* to form a secondary payout section. Second cable 220*b* is anchored to pulley 170 with cable anchor pin 176. Optionally, second cable 220*b* may be anchored in the second pulley track. The other end of second cable 220*b* is trained about the secondary string payout track of the bottom cam assembly. The first and second pulley tracks may also be substantially circular.

The first and second pulley tracks may also be non-circular. An example of a pulley having a non-circular second pulley track is shown at 170 in FIG. 5*b*. The pulley of FIG. 5*b* is similar to that of FIG. 5*a* differing in that second pulley track 172*b* is curved, but not circular. Those of ordinary skill in the art will recognize that curved tracks other than those shown may be used as well.

Any of the above embodiments may also be configured for use as a crossbow, as shown in FIG. 6. Crossbow 100 shown in FIG. 6 is similar to that shown in FIGS. 1–4 differing in that it further comprises stock 245 which includes a trigger and bow string release member as known in the art. The stock and limbs may be of one piece construction or otherwise permanently joined together or may be disassemblable into separate pieces.

Additional details concerning the construction of crossbows may be found in U.S. Pat. No. 5,025,771 and U.S. Pat. No. 4,827,894.

The present invention is also directed to an archery bow comprising a handle portion, an upper limb supported by the handle portion and a lower limb supported by the handle portion. A top pulley is rotatably mounted upon the upper limb for rotation about a first axle. The top pulley includes a pulley track. A bottom cam assembly is rotatably mounted upon the lower limb for rotation about a second axle. The bottom cam assembly has a primary string payout track and a secondary string payout track. The primary string payout track is concentric to the second axle. The primary string payout track is at least semicircular and rotates about its geometric center.

The archery bow may optionally further comprise a first cable having a first end portion terminating in a first end anchored to the bottom cam assembly and a second end portion terminating in a second end anchored to the bottom cam assembly. The first end portion is received in the primary string payout track, the second end portion is received in the secondary string payout track. A portion of the first cable is trained about the top pulley and received in the pulley track to form a bow-string section and a return section.

Where the bottom cam assembly optionally further comprises a takeup track, the archery bow may further comprise an anchor cable extending between the upper limb and the bottom cam assembly and received in the take-up track.

The instant invention is also directed to an archery bow having a rotatably mounted pulley with a track and a rotational dual feed-out element with a larger track and smaller track, wherein the improvement comprises a larger track which is substantially similar in shape and operation to the pulley track.

The invention also contemplates the use of a cam having a non-circular shape provided that the primary string payout track has a constant radius of curvature. Desirably, the primary string payout track will be at least semicircular. Also desirably, the primary string payout track will have a radius of curvature substantially equal to that of the top pulley.

In another embodiment, the invention is directed to an archery bow having a rotatably mounted pulley with a track and a dual feed-out cam with a larger track and a smaller track, the improvement comprising a larger track which is substantially comparable or similar in shape and operation to the pulley track. The larger track and the pulley track may, for example, both be substantially circular, of substantially the same radius. The larger track and the pulley track may both have a constant, substantially identical radius of curvature. In the case of a concentric curve, both the larger track and the pulley track would be of substantially the same shape and dimension.

Other features which may be combined with the inventive bow are described in the following commonly assigned, cofiled U.S. applications:

U.S. application Ser. No. 09/503,013; U.S. application Ser. No. 09/502917; U.S. application Ser. No. 09/502,152; U.S. application Ser. No. 09/502,149; and U.S. application Ser. No. 09/502,643.

In addition to the specific embodiments claimed below, the invention is also directed to other embodiments having any other possible combination of the dependent features claimed below.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. An archery bow comprising:

a handle portion;

an upper limb supported by the handle portion;

a lower limb supported by the handle portion;

a top pulley rotatably mounted upon the upper limb for rotation about a first axle, the top pulley including at least one pulley track; and a bottom cam assembly rotatably mounted upon the lower limb for rotation about a second axle, the bottom cam assembly having a primary string payout track having a first length and a secondary string payout track having a second length, the second length substantially shorter than the first length;

wherein the primary string payout track is characterized by a constant radius of curvature about its axis of rotation.

2. The archery bow of claim 1 wherein the top pulley has a single pulley track.

3. The archery bow of claim 2 wherein the primary string payout track is at least semicircular.

4. The archery bow of claim 2 wherein the primary string payout track is substantially circular.

5. The archery bow of claim 2 wherein the top pulley is characterized by a radius of curvature and the radius of curvature of the primary string payout track is substantially equal to the radius of curvature of the top pulley.

6. The archery bow of claim 2 further comprising a first cable having a first end portion terminating in a first end anchored to the bottom cam assembly and a second end portion terminating in a second end anchored to the bottom cam assembly, the first end portion received in the primary string payout track, the second end portion received in the secondary string payout track, a portion of the first cable trained about the top pulley and received in the pulley track to form a bow-string section and a return section.

7. The archery bow of claim 2 wherein the bottom cam assembly further comprises a takeup track.

8. The archery bow of claim 7 further comprising a first cable having a first end portion terminating in a first end anchored to the bottom cam assembly and a second end portion terminating in a second end anchored to the bottom cam assembly, the first end portion received in the primary string payout track, the second end portion received in the secondary string payout track, a portion of the first cable trained about the top pulley and received in the pulley track to form a bow-string section and a return section.

9. The archery bow of claim 2 configured for use as a crossbow.

10. The archery bow of claim 9 further comprising:

a first cable having a first end portion terminating in a first end anchored to the bottom cam assembly and a second end portion terminating in a second end anchored to the bottom cam assembly, the first end portion received in the primary string payout track, the second end portion received in the secondary string payout track, a portion of the first cable trained about the top pulley and received in the pulley track to form a bow-string section and a return section; and a bow-string drawing device for drawing the bow-string section of the first cable.

11. The archery bow of claim 2 configured for use as a compound bow.

12. An archery bow comprising:

a handle portion;

an upper limb supported by the handle portion;

a lower limb supported by the handle portion;

a top pulley rotatable mounted upon the upper limb for rotation about a first axle, the top pulley having a single pulley track;

a bottom cam assembly rotatably mounted upon the lower limb for rotation about a second axle, the bottom cam assembly having a primary string payout track, a secondary string payout track, and a takeup track;

a first cable having a first end portion terminating in a first end anchored to the bottom cam assembly and a second end portion terminating in a second end anchored to the bottom cam assembly, the first end portion received in the primary string payout track, the second end portion received in the secondary string payout track, a portion of the first cable trained about the top pulley and received in the pulley track to form a bow-string section and a return section; and an anchor cable extending between the upper limb and the bottom cam assembly and received in the take-up track, wherein the primary string payout track is characterized by a constant radius of curvature about its axis of rotation.

13. An archery bow comprising:

a handle portion;

an upper limb supported by the handle portion;

a lower limb supported by the handle portion;

a top pulley rotatably mounted upon the upper limb for rotation about a first axle, the top pulley having more than one pulley track;

a bottom cam assembly rotatable mounted upon the lower limb for rotation about a second axle, the bottom cam assembly having a primary string payout track and a secondary string payout track;

wherein the primary string payout track is characterized by a constant radius of curvature about its axis of rotation.

14. The archery bow of claim 13 wherein the primary string payout track is at least semicircular.

15. The archery bow of claim 13 wherein the primary string payout track is substantially circular.

16. The archery bow of claim 13 wherein the top pulley is characterized by a radius of curvature and the radius of curvature of the primary string payout track is substantially equal to the radius of curvature of the top pulley.

17. The archery bow of claim 13 wherein the top pulley has a first pulley track and a second pulley track, the bow further comprising:

a first cable having a first end portion terminating in a first end anchored to the bottom cam assembly and received in the primary string payout track and a second end portion trained about the first pulley track and terminating in a second end anchored to the pulley to form a bow-string section; and a second cable having a first end portion trained about the second pulley track and terminating in a first end anchored to the pulley and a second end portion received in the secondary string payout track to form a secondary payout section.

18. The archery bow of claim 13 wherein the bottom cam assembly further comprises a takeup track.

19. The archery bow of claim 18 wherein the top pulley has a first pulley track and a second pulley track, the bow further comprising:

a first cable having a first end portion received in the primary string payout track, the first end portion terminating in a first end anchored to the bottom cam assembly and a second end portion trained around the first pulley track and terminating in a second end anchored to the pulley to form a bow-string section; and a second cable having a first end portion received in the secondary string payout track, a portion of the second cable trained about the second pulley track and anchored to the pulley to form a secondary payout section.

20. The archery bow of claim 19 further comprising an anchor cable extending between the upper limb and the bottom cam assembly and received in the take-up track.

21. The archery bow of claim 13 configured for use as a crossbow.

22. The archery bow of claim 21 further comprising:

a first cable having a first end portion received in the primary string payout track, the first end portion terminating in a first end anchored to the bottom cam assembly and a second end portion trained around the first pulley track and terminating in a second end anchored to the pulley to form a bow-string section; and a bow-string drawing device for drawing the bow-string section of the first cable.

23. The archery bow of claim 13 configured for use as a compound bow.

24. An archery bow comprising:

a handle portion;

an upper limb supported by the handle portion;

a lower limb supported by the handle portion;

a top pulley rotatably mounted upon the upper limb for rotation about a first axle, the top pulley including at least one pulley track;

a bottom cam assembly rotatably mounted upon the lower limb for rotation about a second axle; the bottom cam assembly having a primary string payout track and a secondary string payout track, the primary string payout track substantially disposed about the secondary string payout track;

wherein the primary string payout track is characterized by a constant radius of curvature about its axis of rotation.

25. The archery bow of claim 24 having a single top pulley track and further comprising:

a first cable having a first end portion terminating in a first end anchored to the bottom cam assembly and a second end portion terminating in a second end anchored to the bottom cam assembly, the first end portion received in the primary string payout track, the second end portion received in the secondary string payout track, a portion of the first cable trained about the top pulley and received in the pulley track to form a bow-string section and a return section.

* * * * *